US009238905B2

(12) United States Patent
Schless

(10) Patent No.: US 9,238,905 B2
(45) Date of Patent: Jan. 19, 2016

(54) DEVICE FOR DISPENSING AN AMOUNT OF LIQUID AT A REMOVAL STATION

(75) Inventor: Guenther Schless, Wesel (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/240,806

(22) PCT Filed: Jul. 13, 2012

(86) PCT No.: PCT/EP2012/063773

§ 371 (c)(1),
(2), (4) Date: Feb. 25, 2014

(87) PCT Pub. No.: WO2013/026622

PCT Pub. Date: Feb. 28, 2013

(65) Prior Publication Data

US 2014/0205273 A1 Jul. 24, 2014

(30) Foreign Application Priority Data

Aug. 25, 2011 (DE) ..... 10 2011 081 579

(51) Int. Cl.

| | |
|---|---|
| ***F24H 1/10*** | (2006.01) |
| ***E03C 1/02*** | (2006.01) |
| ***F24D 17/00*** | (2006.01) |
| ***F24D 19/10*** | (2006.01) |

(52) U.S. Cl.

CPC ..... *E03C 1/025* (2013.01); *F24D 17/0089* (2013.01); *F24D 19/1051* (2013.01)

(58) Field of Classification Search

None

See application file for complete search history.

(56) References Cited

U.S. PATENT DOCUMENTS

| | | | | | |
|---|---|---|---|---|---|
| 3,202,321 | A | * | 8/1965 | Homeyer | 222/108 |
| 3,378,673 | A | * | 4/1968 | Hopper | 392/472 |
| 3,381,110 | A | * | 4/1968 | Fischer | 392/451 |
| 3,642,176 | A | * | 2/1972 | Dreibelbis et al. | 222/146.5 |
| 4,005,804 | A | * | 2/1977 | Dreibelbis | 222/144.5 |
| 5,076,467 | A | * | 12/1991 | Sugo | 222/3 |
| 5,343,552 | A | | 8/1994 | Peteri | |
| 5,791,377 | A | * | 8/1998 | LaRochelle | 138/33 |
| 6,049,658 | A | * | 4/2000 | Schave et al. | 392/472 |
| 6,701,068 | B2 | * | 3/2004 | Lin | 392/480 |
| 6,792,201 | B1 | | 9/2004 | Tsai et al. | |
| 7,120,354 | B2 | * | 10/2006 | Mackie et al. | 392/480 |
| 2009/0266435 | A1 | | 10/2009 | Ferrone | |

FOREIGN PATENT DOCUMENTS

| | | | |
|---|---|---|---|
| DE | 1670097 | U | 1/1954 |
| DE | 69118036 | T2 | 10/1996 |
| GB | 2452981 | A | 3/2009 |

* cited by examiner

*Primary Examiner* — Thor Campbell

(74) *Attorney, Agent, or Firm* — Laurence Greenberg; Werner Stemer; Ralph Locher

(57) ABSTRACT

A device for dispensing a predetermined, heated amount of liquid at a removal station. The latter has a liquid reservoir, a supply line from the liquid reservoir to the removal station, and an operating device for triggering a liquid removal. The supply line is adapted to the predetermined amount of liquid in regard to the internal volume of the supply line and the supply line is equipped with a heating device over the length of the supply line.

6 Claims, 1 Drawing Sheet

DEVICE FOR DISPENSING AN AMOUNT OF LIQUID AT A REMOVAL STATION

BACKGROUND OF THE INVENTION

Field of the Invention

The invention relates to a device for dispensing a predetermined, heated amount of liquid at a removal station, comprising a liquid reservoir, a supply line from the liquid reservoir to the removal station, and an operating device for triggering a removal of liquid.

Such devices are used, for example, in the sanitary area of rail vehicles, wherein the operating device frequently used is a sensor which, for example, detects the presence of a person at a wash basin as the removal station. A predetermined amount of liquid is subsequently dispensed at the removal station. The removal station is connected via a supply line to a remotely arranged liquid reservoir.

Devices of the aforementioned type can be found, for example, in many different designs of high-speed trains, such as, for example, the Velaro RUS.

In rail vehicles, drinking water and fresh water intended for human consumption is carried along in the liquid reservoir and supplied to the removal station as required. The reservoir is filled from a stationary water network at suitable intervals of usually a few days. The temperature of the freshly supplied water frequently has a temperature which is unacceptably cold for the use of the water. Depending on the origin of the water, the line routing and time of year, a water temperature here can even lie below 10° C. In order to provide a comfortable temperature, it is therefore desirable for the water at the removal station in the rail vehicle, such as, for example, the hand wash basin, to be made available at a higher temperature.

For this purpose, it is known to preheat the complete water supply in the liquid reservoir to a desired temperature. However, this has the disadvantage that the entire water supply must be heated, with a heating power requirement being governed by the storage quantity. An amount of water actually consumed, the consumption interval and the heating power actually required are not taken into account in the design. In addition, a storage of drinking and fresh water at elevated temperatures is problematic for reasons of hygiene. Depending on the stored liquid volume, the desired comfort properties are achieved only after a considerable time delay or by means of over-dimensioning the heating device.

As an alternative to heating the complete water supply, in other embodiments there is provided an additional intermediate container which is arranged along the path between the water reservoir and removal station. In the case of such an intermediate container, the ratio of volume to heatable surface area is poor, so that heating has to be carried out with high temperature differences. This results in high demands on the material for the intermediate container and the heating device and also on the behavior in the case of a defect. Furthermore, regions with low, partially nonuniform flow rates and poor flushing are created in such an intermediate container, which is objectionable for reasons of hygiene. Joints, which represent an additional risk of leakage, are necessary in the supply line/piping. The supply region is often strongly heated at intervals for disinfection. At this time, either only water having much too high a temperature is made available or cold water has to be added. In addition to the increased installation complexity, this can also result in risks for the user in the case of malfunctions.

BRIEF SUMMARY OF THE INVENTION

Taking this as the starting point, the invention is based on the object of developing the device described at the outset in such a way that heating of the liquid can be effected in a more energy-saving manner and hygiene constraints are also taken into account for the design of the device.

This object is achieved in that the supply line is adapted in terms of its internal volume to the determined amount of liquid, and the supply line is equipped over its length with a heating device.

The liquid to be heated that is used is primarily drinking water, fresh water and service water for use in the sanitary area of rail vehicles. However, in principle, the device can also be applied to mobile and stationary systems in which liquids are intended to be heated along the path from a storage region to the use or consumption region, including operating and process liquids.

In the device, it is assumed that a removal of, for example, drinking water and fresh water at the removal station takes place noncontinuously and over a prolonged period. Rather, only a predefined amount of water demanded by the user is removed in each case. Here, the demand can also be met in multiple consecutive stages. Activation cycles for the device for the removal of, for example, fresh water in the sanitary area of a rail vehicle are repeatedly interrupted by periods in which a user enters or leaves the room, the WC is used or, in general, the device is not used. In these non-use intervals, heating of the liquid in the supply line takes place.

The device is distinguished in terms of its operation in that manageable constraints with regard to hygiene requirements are present, additional reservoirs for heating the liquid are avoided, and temperature peaks with negative effects on hygiene and materials are avoided.

It is of particular importance to tailor the preheated volume to an average demand at the removal station. This tailoring occurs as a result of the fact that a supply line volume is dimensioned according to the demand.

An installed heating power can also be tailored to the necessary heating requirement while taking account of the volume and the available preheating time.

Moreover, a temperature level is minimized to a comfort temperature which is actually required, while an electric supply power can be limited to the minimum necessary for meeting the requirements.

It can be regarded as advantageous that a control device for the heating device is designed in such a way that a heating power for heating the liquid from a supply temperature to a comfort temperature within a heating interval is determined on the basis of constraints which are selected from the group which comprises a use interval for the removal station, a number of activation repetitions of the removal station per use interval, liquid volume removed per activation of the removal station, volume of the liquid reservoir, and daily use time. In this way, the heating power is limited to a required minimum.

For reasons of energy saving, the supply line can be thermally insulated to the outside.

The heating device for the supply line can be controlled in such a way that the liquid is heated in the supply line when no liquid removal takes place. This results in an, if appropriate, irregular interval heating of the liquid in the supply line.

The course of the supply line from the liquid reservoir to the removal station can be predetermined, in which case the size of the internal volume is determined over a free internal cross section of the supply line. For example, the supply line for a sanitary cell of a rail vehicle has a predetermined path from a liquid reservoir to the removal station in the sanitary cell. The resulting length of the supply line is noted to be predetermined. A free internal cross section of the supply line is then determined according to the typical consumption at the removal station. Such a typical consumption can be, for example, an on average double actuation of the device for dispensing the predetermined amount of liquid.

The free cross section of the supply line is preferably uniform over the entire length of the supply line, but can also be discontinuous.

An exemplary embodiment of the invention will be explained in more detail below with reference to the drawing, in which:

DESCRIPTION OF THE INVENTION

Figure 1:
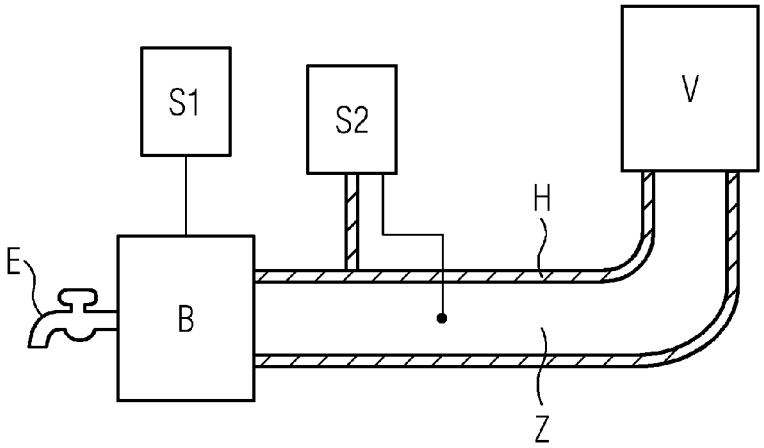
FIG. 1 shows a block diagram representation of a device for dispensing a heated amount of liquid at a removal station.

FIG. 1 reveals the general construction of the device for dispensing a predetermined, heated amount of liquid. In the present exemplary embodiment, fresh water is situated in a liquid reservoir V and is supplied, via a tubular supply line Z and an operating device B, to a removal station E, in this case a water faucet.

The operating device B is either operated directly or triggered in a contact-free manner, for example by means of an infrared or radar sensor S1. Here, it is detected when a person is situated in the spatial area of the removal station E. In this case, the operating device B triggers a dispensation of fresh water at the removal station E.

The supply line Z is equipped over its entire length with a heating device H, so that an entire internal volume of the supply line Z can be used for heating up fresh water. As an alternative, the supply line Z may also only be heated in certain portions. The heating device H is controlled by a control device S2 which supplies the heating device H with current via suitable electrical supply lines and in addition switches or regulates the supplied electrical power as a function of the measured temperature.

An internal cross section of the supply line Z is designed to be cylindrical and is uniform over the entire length of the supply line Z. When an assembly path for the supply line Z from the reservoir V to the removal station E is determined, an internal diameter of the supply line Z is dimensioned in the design of the device in such a way that a suitable liquid volume, here a fresh water volume, can be heated in the supply line Z. Cross-sectional modifications may also be provided as a function of the distance to be bridged, the available installation space and the required volume.

If, for example, it has been determined empirically beforehand that the operating device B is typically triggered twice during hand-washing at the removal station E, the internal volume of the supply line Z is dimensioned such that the predetermined amount of liquid corresponds to double that which is dispensed at the removal station E during a single operation of the operating device B. In this way, sufficiently heated fresh water is available in the supply line Z for the usual case of consumption.

Figure 2:
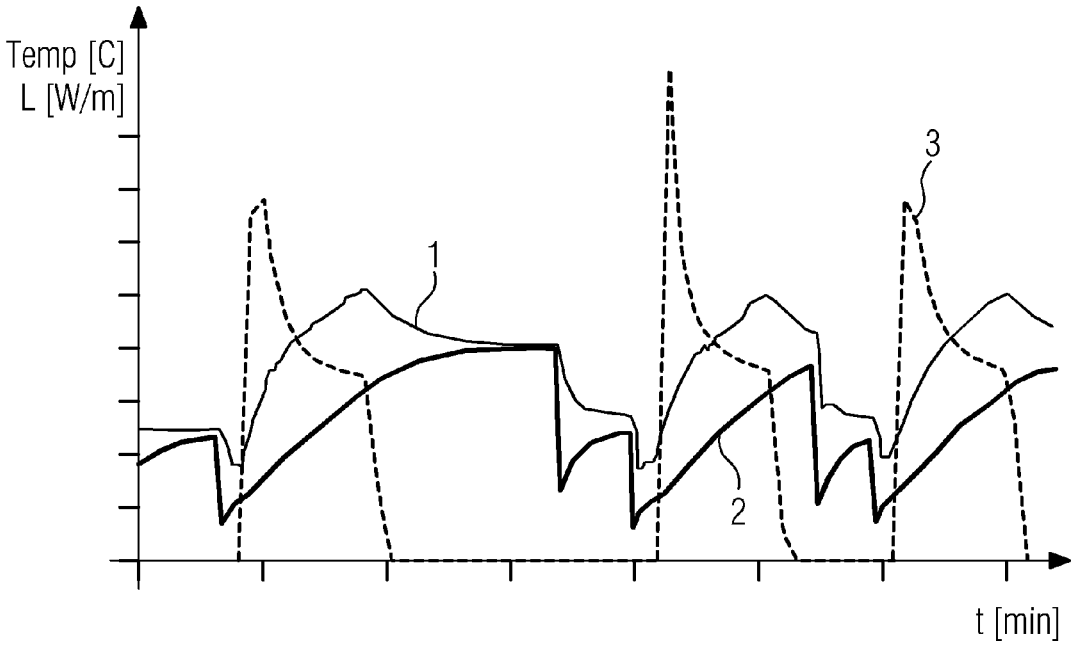
FIG. 2 shows a combined graphical representation of a respective time profile of a supply line temperature, a water temperature and a heating power over a plurality of heating intervals.

FIG. 2 shows the heating power profile and temperature profile over a plurality of heating intervals. The heating device H is operated when the temperature level of the or in the supply line Z has fallen below a desired value. In FIG. 2, the dashed line shows the profile of the electrical heating power, which, expressed generally, in each case increases strongly in the three heating intervals represented, then drops approximately exponentially and thus then assumes a value close to zero. The upper of the two temperature curves shown as a solid line in each case relate to a pipe temperature, while the lower curve represents the water temperature within the supply line Z. It can be seen that the pipe temperature initially rises to a maximum owing to the action of the heating device H, after which the temperatures of the pipe and of the fresh water then approach one another.

The present invention has been explained by way of an example which relates to the dispensing of predetermined amounts of fresh water in the sanitary area of a rail vehicle. However, an adapted use of the invention can also be used in the case of other liquids, such as service water, drinking water, operating and process liquids.

It should be emphasized that the device represented is also associated, in terms of its operation, with a frost-proofing effect for the supply line Z and the operating device B.

The invention claimed is:

1. A device for dispensing a predetermined, heated amount of liquid at a removal station, comprising:

a liquid reservoir;

a supply line leading from said liquid reservoir to the removal station, said supply line having a defined length and inner diameter to define an internal volume substantially equal to the predetermined amount of liquid;

a heating device effective along a length of said supply line, or in sections of said supply line;

an operating device for triggering a removal of liquid at the removal station in an amount substantially equal to the predetermined amount or an integer fraction thereof;

a control device for controlling said heating device, said control device being configured to determine a heating power for heating the liquid from a supply temperature to a given comfort temperature within a heating interval based on one or more constraints selected from the group consisting of: a use interval for said removal station, a number of activation repetitions of said removal station per use interval, liquid volume removed per activation of said removal station, a volume of said liquid reservoir, and a daily use time of the device.

2. The device according to claim 1, wherein said supply line is thermally insulated to an outside.

3. The device according to claim 1, wherein said heating device for heating said supply line is configured to heat the liquid in said supply line when no liquid removal is taking place.

4. The device according to claim 1, wherein said heating device for heating said supply line is configured to heat the liquid in said supply line when liquid removal is taking place.

5. The device according to claim 1, wherein a course of said supply line from said liquid reservoir to said removal station is predetermined, and a size of the internal volume is determined over an internal cross section of said supply line.

6. The device according to claim 5, wherein the internal cross section of the supply line is uniform over an entire length of the supply line.

* * * * *